United States Patent [19]

McGuire et al.

[11] 3,946,867

[45] Mar. 30, 1976

[54] BOOK HAVING A SECURITY COVER

[75] Inventors: John V. McGuire, Deerfield; Robert L. Mitchell, Libertyville, both of Ill.

[73] Assignee: Xerox Corporation, Stamford, Conn.

[22] Filed: Mar. 27, 1975

[21] Appl. No.: 562,625

[52] U.S. Cl. ..... 206/450; 11/2; 206/424; 206/472; 229/1.5 R; 229/87 R; 281/19 R

[51] Int. Cl.[2] ..... B65D 65/14; B65D 65/28

[58] Field of Search ..... 206/424, 472, 474, 451, 206/453, 450, 449; 229/87 R, 1.5 R; 11/1 AD, 2, 3, 1 AC; 281/19 R, 20

[56] References Cited

UNITED STATES PATENTS

| | | | |
|---|---|---|---|
| 462,027 | 10/1891 | Bailey | 11/3 |
| 1,077,537 | 11/1913 | MacMillan | 206/451 |
| 1,162,750 | 12/1915 | Canfield | 206/449 |
| 2,330,619 | 9/1943 | Pomeranz | 229/87 R |
| 3,099,464 | 7/1963 | Smith | 281/20 |
| 3,199,896 | 8/1965 | Caddoo | 11/2 |

*Primary Examiner*—William Price
*Assistant Examiner*—Bruce H. Bernstein

[57] ABSTRACT

A covered book comprises: a stack of aligned sheets, including a front and back cover, providing an edge surface; a first protective sheet located adjacent the outside of the front cover; a second protective sheet located adjacent the outside of the back cover; and a binding strip fixed to the edge surface, to an area on each of the covers, and to an area on each of the protective sheets. The first protective sheet is wrapped around the unbound edge of the book and is fixed with a pressure sensitive adhesive to the second protective sheet, thereby providing a protective cover for the book. Each of the protective sheets is scored to permit removal of at least part of the protective cover when it is no longer required.

8 Claims, 3 Drawing Figures

BOOK HAVING A SECURITY COVER

The subject invention generally relates to books having protective covers and, in particular, to a book integrally manufactured with a removable protective cover. It should be noted that a method, disclosed hereinafter, for manufacturing said book is the subject matter of a U.S. application contemporaneously filed herewith.

In business offices multi-page reports are frequently bound with adhesive strips to provide books for local and distant distribution. To keep the books closed during distribution the books are often placed in envelopes or have a band individually placed around them. While bands facilitate handling of books during a distribution process they are not useful when books contain sensitive subject matter because bands may be slipped into association and disassociation with a book without detection. Similarly, when envelopes are used for distributing or mailing books, books may be removed from the envelopes, may be read, and may be reinserted in suitably addressed and similar envelopes.

It is an object of the present invention to provide mailable books having integrally associated protective covers.

It is another object of the present invention to provide a book having a security cover, any opening or removal of the cover being readily detectable.

Briefly, the invention herein provides a covered book. Structurally, the book comprises: (a) a stack of aligned sheets providing an edge surface; (b) a first protective sheet located adjacent the first sheet of the stack; (c) a second protective sheet located adjacent the last sheet of the stack and said first protective sheet; (d) an adhesive binding strip fixed to the sheets along said edge surface and to the outside of the protective sheets; and (e) means for fixing the first protective sheet to the second protective sheet.

Additional objects and features of the invention will become apparent by reference to the following description in conjunction with the accompanying drawings, in which.

Figure 1:
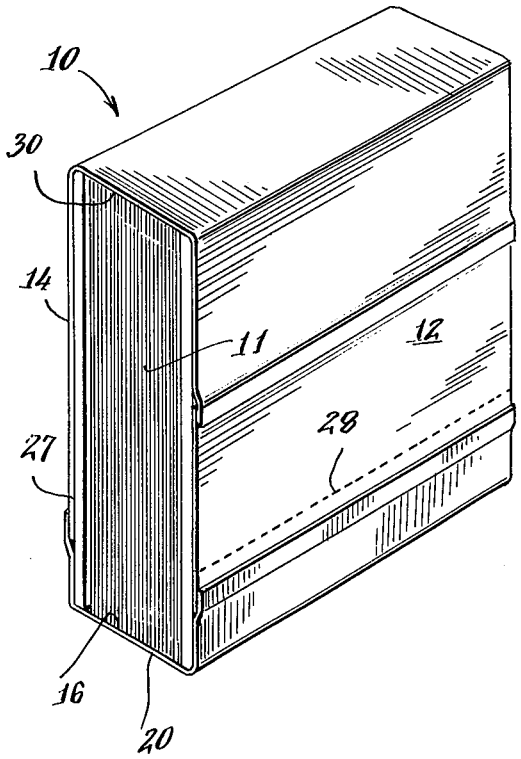
FIG. 1 is a perspective view of a book, according to the invention.
Figure 2:
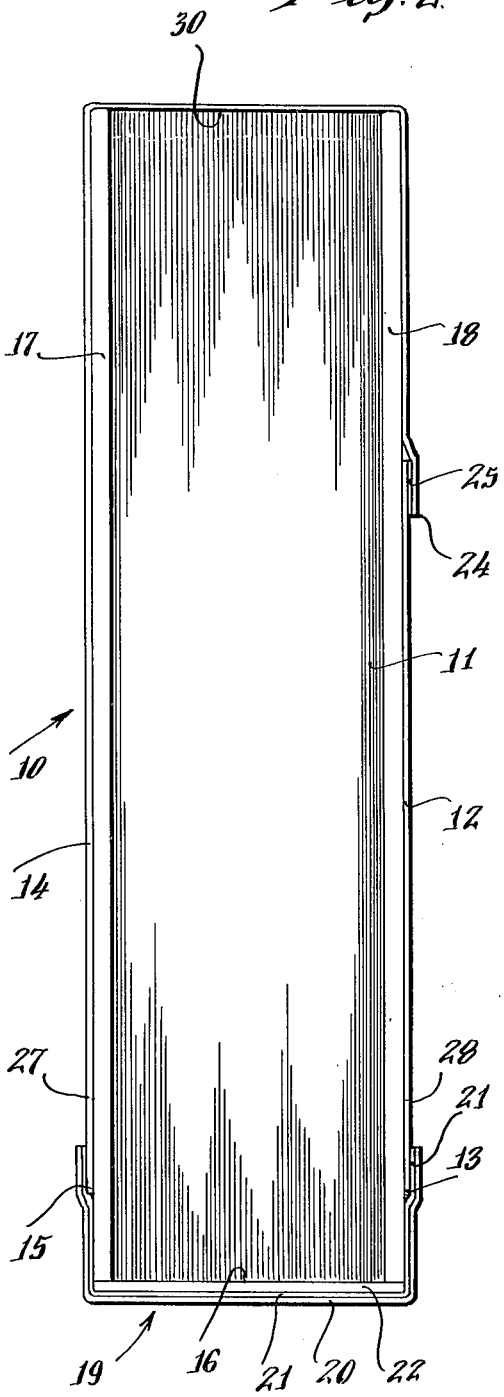
FIG. 2 is a plan view of an end of the book shown in FIG. 1.

Referring to FIGS. 1 and 2, a book 10, according to the invention, includes a rectangular stack of aligned sheets 11, 17, and 18 providing an edge surface 16. Adjacent the first sheet 18 of the stack there is located a rectangular protective sheet 12. Sheet 12, for example, may be manufactured from kraft paper with length and width dimensions suitable for covering a longitudinal section of sheet 18. Adjacent the last sheet 17 of the stack there is located another protective sheet 14 which, for example, may be manufactured from kraft paper. Rectangular sheet 14 has a width dimension large enough to cover the length of the book and long enough to extend around edge 30 of the stack into overlapping relationship with sheet 12. The stack of aligned sheets 11, 17 and 18 and the protective sheets 12 and 14 are mutually coupled by an adhesive bearing strip 19.

Figure 3:
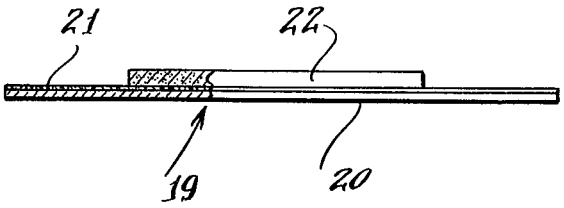
FIG. 3 is a plan view of an end of the adhesive bearing strip, used in making the book, shown in FIGS. 1 and 2, a section of the strip having been removed to more fully disclose components of the strip.

As disclosed in FIG. 3, adhesive strip 19 comprises a formable substrate 20 of, typically, relatively heavy paper stock, and adhesive coatings 21 and 22. Adhesive coatings 21 and 22 constitute a plurality of strip-like formations comprising two heat activated adhesive types. Heat activated adhesive may be either of the low or high tack types. A low tack adhesive comprises an adhesive material which when heated becomes fairly molten or fluid, thereby providing a high degree of surface wet-out with a minimum application of pressure or heat. A typical low tack adhesive may be a mixture of about 80 percent by weight of an ethylene/-vinyl acetate copolymer having a 90 percent ratio of ethylene to vinyl acetate and about 20 percent by weight of rosin acid ester. A high tack adhesive comprises an adhesive material which when heated remains highly viscous and somewhat immobile so that a definite amount of heat is necessary to wet-out a surface being adhered. A typical high tack adhesive may be a mixture of polyethylene, a rosin acid, and a metal salt of a carboxylic acid, present in weight proportions of 80/10/10, respectively. High tack adhesives have the advantage that, on application of heat and pressure, the bond created thereby immediately possesses a high degree of strength. On the other hand, the low tack adhesive flows readily or is wicked into the edges of paper sheets to be bound. The strip 19 preferably has the high tack adhesive 21 uniformly applied to the substrate 20 while the low tack adhesive 22 is applied along the center line of the substrate with a relatively greater thickness than that of the high tack material. Typically, the width of the adhesive 22 is approximately equal to or slightly greater than the overall thickness of the stack of sheets 11.

Referring to FIGS. 1 and 2, protective sheet 14 extends snugly around the unbound edge 30 of the stack of sheets and is fixed, near its end 24, by an adhesive 25 to protective sheet 12. Adhesive 25 may be of the pressure sensitive type and, preferably, should have a holding strength sufficient to prevent separation of protective sheets 12 and 14 unless detectable tearing of either of the sheets 12 and 14 occurs.

Sheet 12 is scored with a linear series of slits 28 spaced from and parallel to edge 13 of the sheet and binding strip 19 is fixed to an area between slit 28 and edge 13. Similarly, sheet 14 is scored with a linear series of slits spaced from its end 15 and adhesive strip 19 is fixed to an area of sheet 14 which is located between slit 27 and end 15. Thus, substantial sections of the protective sheets 12 and 14 may be separated from the book along the series of slits 28 and 27, respectively, when they are no longer required.

Ends 13 and 15 of protective sheets 12 and 14, respectively, may be located so as to coincide with edge surface 12; however, it is preferred that they be spaced away from the edge surface to provide areas on sheets 17 and 18 engageable by strip 19. The stated preference exists because when said substantial parts of the protective sheets 12 and 14 are removed sheets 17 and 18 will remain as covers and in normal use shear stresses between adhesive strip 19 and sheets 17 and 18 are expected. Since sheets 17 and 18 will serve as covers when the protective sheets are at least partially removed they should be manufactured from stock which is thicker and more durable than the sheets which make up the pages of book 10.

The book 1, described above, may be manufactured by aligning the stack of sheets 11, 17 and 18 to provide edge surface 16. The alignment may be accomplished, for example, by jogging the sheets against a flat surface. During or after the alignment step sheets 12 and 14 may be located, as described above, adjacent sheets 18 and 17, respectively. Thereafter, adhesive strip 19 is fixed to the edge surface 16, the protective sheets 12 and 14, and when the preference stated above is desired, to sheets 17 and 18. The alignment of the stack of sheets and the location of the protective sheets are steps which may be adequately performed manually. However, fixing of the adhesive strip 19 to the resulting structure is best accomplished with a bookbinding machine such as is dsclosed in pending U.S. patent application Ser. No. 474,840, filed May 30, 1974 by R. Kuhns. Subsequently, protective sheet 14 may be fixed to protective sheet 12 with, for example, a suitable adhesive.

It is noted that binding strips and applicators other than those described above may be used to provide covered books according to the invention. In view of this and the fact that other modifications which do not deviate from the spirit of the invention will be readily apparent to those skilled in the art, it is to be understood that the description set forth above of a preferred embodiment of the invention has been set forth as an example thereof and is not to be construed or interpreted as a limitation on the claims which follow and define the invention.

What is claimed is:

1. A covered book, comprising:

a. a stack of aligned sheets providing an edge surface;

b. a first protective sheet located adjacent the first sheet of the stack;

c. a second protective sheet located adjacent the last sheet of the stack and said first protective sheet;

d. an adhesive binding strip fixed to the sheets along said edge surface and to the outside of the protective sheets; and e. means for fixing the first protective sheet to the second protective sheet.

2. A covered book as defined in claim 1 wherein said first protective sheet is scored along a region which is adjacent to but out of contact with the binding strip; and wherein said second protective sheet is scored along a region which is adjacent to but out of contact with the binding strip.

3. A covered book as defined in claim 2 wherein said adhesive binding strip includes a low tack adhesive for binding the strip to said edge surface of the stack and high tack adhesive for fixing the binding strip to said protective sheets.

4. A covered book as defined in claim 3 wherein said means for fixing the first protective sheet to the second protective sheet is a pressure sensitive adhesive.

5. A covered book as defined in claim 4 wherein each of the first and last sheets of said stack are thicker than the other sheets in the stack.

6. A covered book as defined in claim 4 wherein each of the protective sheets is a sheet of kraft paper.

7. A covered book as defined in claim 2 wherein said binding strip is adhesively fixed to an area on the first sheet of the stack and to another area on the last sheet of the stack, each of the areas being contiguous with said edge surface.

8. A covered book as defined in claim 7 wherein said adhesive binding strip includes a low tack adhesive for binding the strip to said edge surface of the stack and high tack adhesive for fixing the binding strip to said protective sheets.

* * * * *